US005938121A

United States Patent [19]

Ferguson et al.

[11] Patent Number: 5,938,121

[45] Date of Patent: Aug. 17, 1999

[54] POP-UP SPRINKLER HOUSING

[76] Inventors: William E. Ferguson, 1689 Dublin Rd., Deltona, Fla. 32738; Leigh A. Morehouse, 301 Wellington St., Miramichi City, New Brunswick, Canada, E1N1P1

[21] Appl. No.: 08/918,169

[22] Filed: Aug. 25, 1997

[51] Int. Cl.[6] ..... B05B 15/08

[52] U.S. Cl. ..... 239/203; 239/201; 239/207; 239/288.5

[58] Field of Search ..... 239/285–288, 239/201–207

[56] References Cited

U.S. PATENT DOCUMENTS

| | | | |
|---|---|---|---|
| D. 314,419 | 2/1991 | Rosenfeld | D23/214 |
| 3,084,869 | 4/1963 | Huffy et al. | 239/201 |
| 3,265,310 | 8/1966 | Cohen | 239/201 |
| 3,929,288 | 12/1975 | Brusadin et al. | 239/288.5 X |
| 4,010,901 | 3/1977 | Sheets | 239/204 |
| 4,108,439 | 8/1978 | McGuire | 273/176 R |
| 4,763,837 | 8/1988 | Livneh | 239/111 |
| 4,781,327 | 11/1988 | Lawson et al. | 239/203 |
| 4,834,296 | 5/1989 | Bailey | 239/204 X |
| 5,102,048 | 4/1992 | Bohnoff | 239/201 |
| 5,137,307 | 8/1992 | Kinsey | 285/156 |
| 5,213,262 | 5/1993 | Violette | 239/203 |
| 5,390,960 | 2/1995 | Blake | 239/204 X |

FOREIGN PATENT DOCUMENTS 6-277566 10/1994 Japan .

*Primary Examiner*—Kevin Weldon
*Attorney, Agent, or Firm*—Edward M. Livingston, Esq.

[57] ABSTRACT

A pop-up-sprinkler housing has a cap sleeve (1) that slides adjustably into a base sleeve (2) having a base plate (3) with a fluid conveyance (4) that screws onto underground sprinkler plumbing (10) and into sprinkler shafts (8). A housing cap (11) on top of the cap sleeve has a sprinkler-shaft aperture (12) that is sized and shaped to allow ingress and egress of pop-up portions (13) of select sprinkler shafts and has cap-sleeve shoulders (14) that extend over the base sleeve and a support surface (15). Threaded fasteners are provided for attaching the fluid conveyance to the sprinkler shafts and to the underground sprinkler plumbing. A plurality of sprinkler adapters 31 are provided for adaptation to different sizes and types of pop-up sprinklers.

12 Claims, 3 Drawing Sheets

FIG. 2
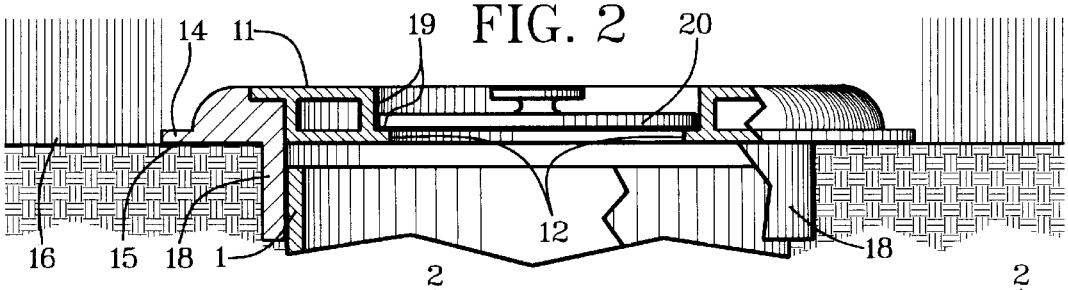
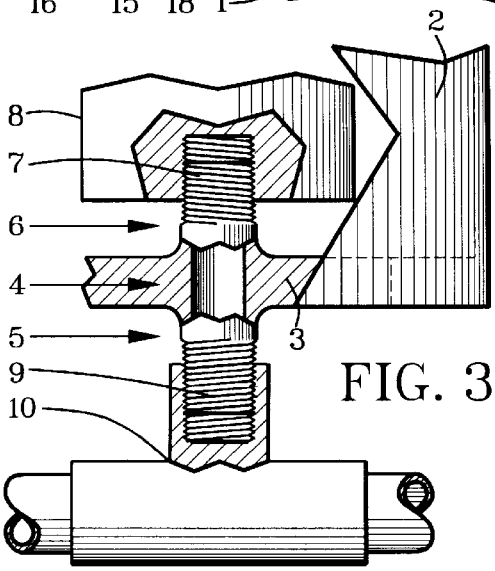
FIG. 3
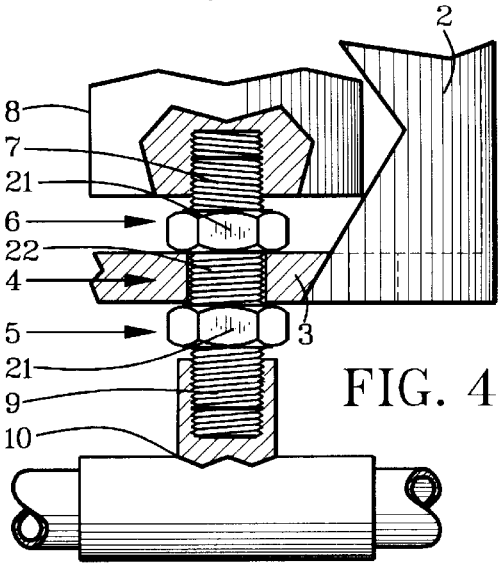
FIG. 4
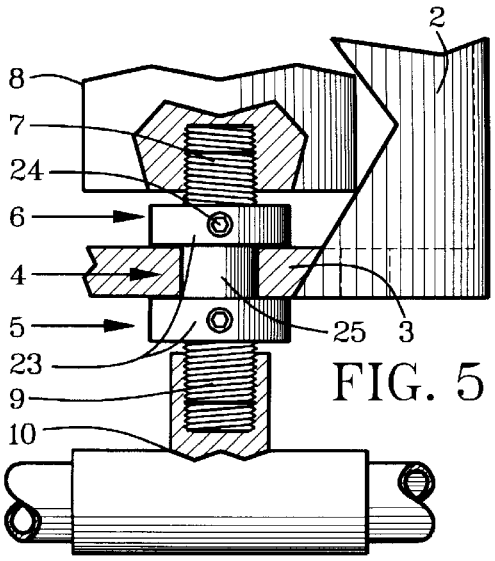
FIG. 5
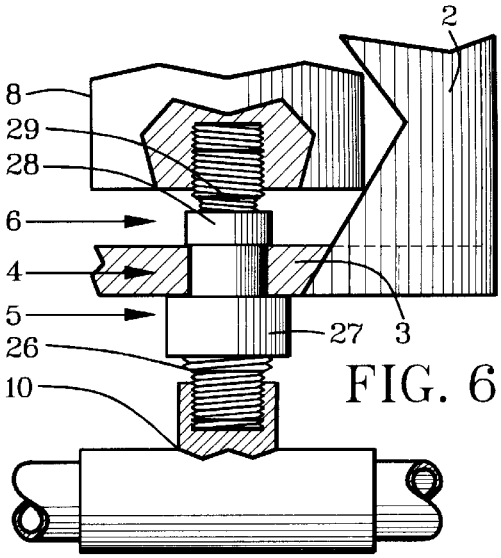
FIG. 6

POP-UP SPRINKLER HOUSING

BACKGROUND OF THE INVENTION

This invention relates to pop-up sprinklers and in particular to a housing for protection against intrusion of sand, dirt and debris into pipe threading, into underground pipes to which they connect and onto related sprinkler components when the sprinklers are repaired, replaced, removed for cold-weather-freeze protection or otherwise displaced.

Currently, pop-up sprinklers about 6-to-10 inches long and 1½-to-2½ inches in diameter are inserted into holes in ground to where they are pipe-threaded vertically onto underground pipe threads. When the sprinklers are removed for adjustment, repair, replacement or for cold-weather-freeze protection, sand, dirt and debris from sides of the holes and from around the holes falls in onto pipe threading, enters the pipe and often caves into the holes. In addition, some types of soil sticks to the sprinklers and makes their replacement in the holes difficult. Cleaning the holes out and cleaning the sprinklers off to put them back into the holes requires considerable time, effort, frustration and cost. There are no known means for solving this problem with the convenience, efficiency and effectiveness of this invention.

Examples of different but related means are described in the following patent documents. Japanese Patent Publication Number 06277566 A, filed by Chiaki, et al., described a cylindrical housing above the ground to fit over a rotating sprinkler that projected above ground surface. U.S. Pat. No. 5,213,262, issued to Violette, described a sprinkler-head guard with an annulus for containing ballast material around a sprinkler cylinder. U.S. Pat. No. 5,137,307, issued to Kinsey, described a single sleeve housing without length adjustment for covering a pop-up sprinkler head. U.S. Pat. No. 4,763,837, issued to Livneh, taught a water-release valve on a sprinkler head for preventing cold-weather freezing. U.S. Pat. No. 4,781,327, issued to Lawson, et al., taught a protective sleeve that was raised and lowered protectively by raising and lowering of a pop-up sprinkler head. U.S. Pat. No. 4,010,901, issued to Sheets, taught a pop-up sprinkler in a protective housing. U.S. Pat. No. 3,265,310, issued to Cohen, taught a protective cylinder positioned in ground around a sprinkler and having a removable lid.

SUMMARY OF THE INVENTION

In light of continuing need for improvement of sprinkler protection, objects of this invention are to provide a pop-up-sprinkler housing which:

Prevents sand, dirt and debris from caving into sprinkler holes and entering underground plumbing when pop-up sprinklers are removed for service, replacement or winter storage in freeze zones; and Prevents contact of outside surfaces of pop-up sprinklers with sticky soil and other material that cause deterioration and obstruct movement of a pop-up-sprinkler shaft in and out of a hole in the ground for pop-up action and for servicing.

This invention accomplishes these and other objectives with a pop-up-sprinkler housing having a cap sleeve that slides adjustably into a base sleeve having a base plate with a fluid conveyance that screws onto underground sprinkler plumbing and into a sprinkler shaft. A housing cap on top of the cap sleeve has a sprinkler-shaft aperture that is sized and shaped to allow ingress and egress of pop-up portions of select sprinkler shafts and has cap-sleeve shoulders that extend over the base sleeve and a support surface. Thread fastener means are provided for attaching the fluid conveyance to the sprinkler shafts and to the underground sprinkler plumbing.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

FIG. 2 is a partially cutaway fragmentary top section with a sprinkler shaft removed for servicing or for winter storage and having a protective cap;

FIG. 3 is a partially cutaway fragmentary pipe-attachment section with an affixed pipe nipple for attachment to underground sprinkler plumbing and to a pop-up-sprinkler shaft;

FIG. 4 is a partially cutaway fragmentary pipe-attachment section showing a pipe nipple affixed with straight-thread fastener nuts on straight threads inwardly from pipe threads for attachment to underground sprinkler plumbing;

FIG. 5 is a partially cutaway fragmentary pipe-attachment section showing a pipe nipple affixed with set-screw sleeves inwardly from pipe threads for attachment to underground sprinkler plumbing;

FIG. 6 is a partially cutaway fragmentary pipe-attachment section showing a combination pipe nipple for attachment to underground sprinkler plumbing;

DESCRIPTION OF PREFERRED EMBODIMENT

Figure 1:
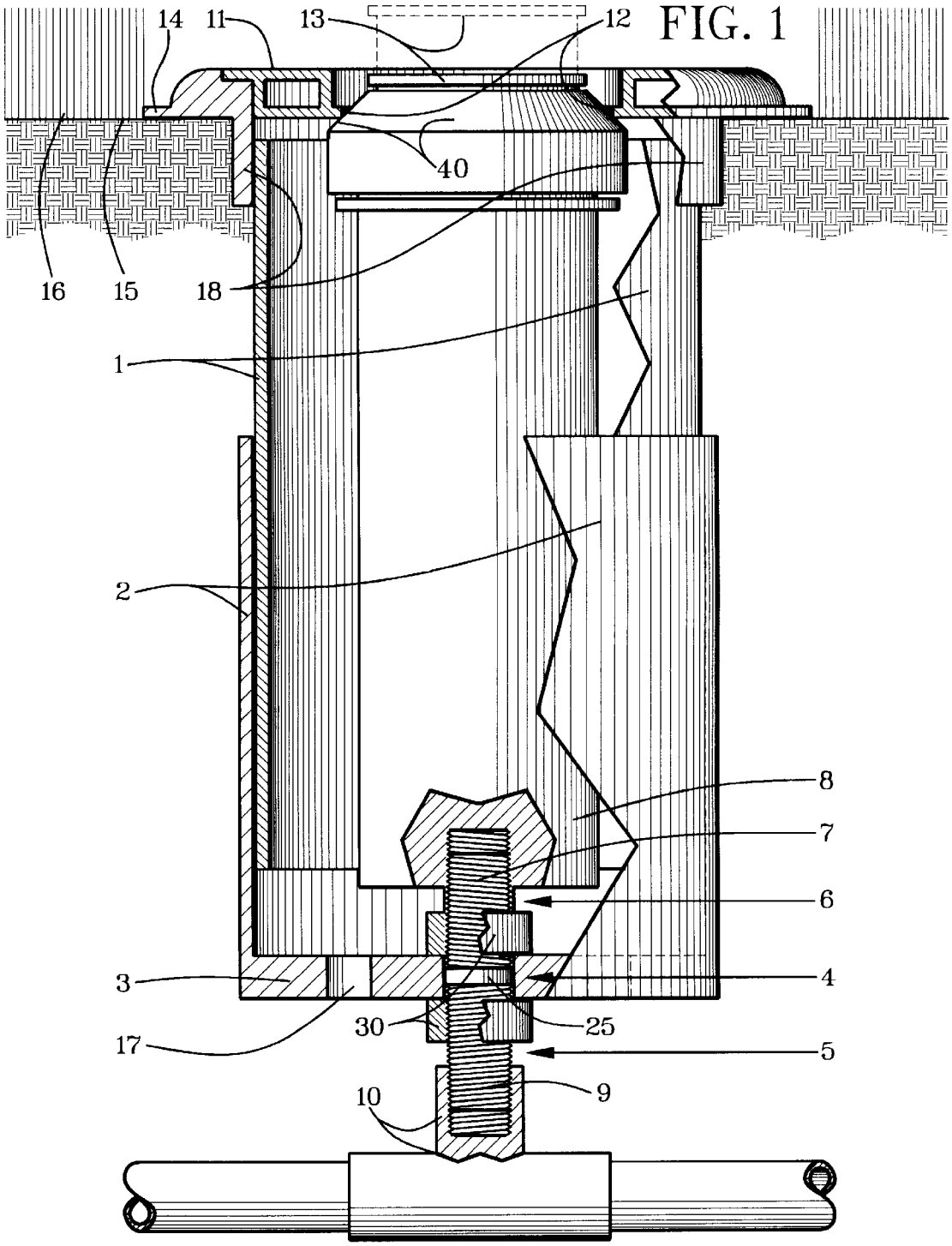
FIG. 1 is a partially cutaway elevation view.

For purposes of describing the preferred embodiment, the terminology used in reference to the numbered components in the drawings is as follows:

| | |
|---|---|
| 1. | Cap sleeve |
| 2. | Base sleeve |
| 3. | Base plate |
| 4. | Fluid conveyance |
| 5. | Pipe-attachment portion |
| 6. | Sprinkler-attachment portion |
| 7. | Top machine threads |
| 8. | Sprinkler shaft |

-continued

| | |
|---|---|
| 9. | Bottom machine threads |
| 10. | Underground sprinkler plumbing |
| 11. | Housing cap |
| 12. | Sprinkler aperture |
| 13. | Pop-up portions |
| 14. | Cap-sleeve shoulder |
| 15. | Top surface |
| 16. | Sprinkler-irrigation surface |
| 17. | Drain orifice |
| 18. | Attachment sleeve |
| 19. | Circumferential step |
| 20. | Step cap |
| 21. | Straight-thread nuts |
| 22. | Straight threads |
| 23. | Set-screw sleeves |
| 24. | Set screws |
| 25. | Pipe nipple |
| 26. | First reducer pipe nipple |
| 27. | First connector sleeve |
| 28. | Second connector sleeve |
| 29. | Second reducer pipe nipple |
| 30. | Pipe sleeve nuts |
| 31. | Sprinkler adapters |
| 32. | Snap bosses |
| 33. | First walls |
| 34. | Snap receptacles |
| 35. | Second walls |
| 36. | Leaf threads |
| 37. | Circumferential-channel threads |
| 38. | Thread-entry bays |
| 39. | Top channel walls |
| 40. | Pop-up-housing portion |

Reference is made first to FIG. 1. A cap sleeve 1 has an outside periphery in sliding contact with an inside periphery of a base sleeve 2 with an open top end through which the cap sleeve 1 is inserted selectively into the base sleeve 2. A bottom end of the base sleeve 2 has a base plate 3. A fluid conveyance 4 attached centrally to the base plate 3 has a pipe-attachment portion 5 extended linearly downward from a bottom surface of the base plate 3 and a sprinkler-attachment portion 6 extended linearly upward from a top surface of the base plate 3.

The sprinkler-attachment portion 6 of the fluid conveyance 4 has top machine threads 7 onto which select types and sizes of sprinkler shafts 8 can be screwed. The pipe-attachment portion 5 of the fluid conveyance 4 has bottom machine threads 9 that can be screwed into underground sprinkler plumbing 10.

A top end of the cap sleeve 1 has a housing cap 11 with a sprinkler aperture 12 that is sized and positioned centrally in the housing cap 11 to allow ingress and egress of pop-up portions 13 of the sprinkler shafts 8. A cap-sleeve shoulder 14 is extended outward radially from the cap sleeve 1 for arresting excessive entry of the cap sleeve 1 into the base sleeve 2 by positioning the cap-sleeve shoulder 14 on a select top surface 15 of an area at a desired height in relationship to a targeted sprinkler-irrigation surface 16 that is represented by vertical lines to indicate lawn and other irrigable vegetation.

The base plate 3 can have at least one drain orifice 17 to allow underground escape of residual water.

The housing cap 11 can be attached detachably to the cap sleeve 1 with attachment sleeves 18 or other means. This allows use of housing caps 11 having different sizes and shapes of sprinkler apertures 12 for different sizes and types of pop-up sprinklers having different sizes and types of sprinkler shafts 8 or substitutional equivalents thereof. Sizes and shapes of the cap sleeve 1 and the base sleeve 2 also can be adjusted to different types, sizes and shapes of pop-up sprinklers. With a wide selection of sizes of sprinkler apertures 12 for a selection of sizes of cap sleeves 1 and base sleeves 2, this pop-up-sprinkler housing is highly adaptable to different types and sizes of pop-up sprinklers.

The underground sprinkler plumbing 10 generally is made of PVC but can be metallic. Although PVC is a preferred material for construction of this invention and for underground sprinkler plumbing 10, other types of materials are foreseeable and intended within the scope of this invention.

Referring to FIG. 2, the housing cap 11 can have a circumferential step 19 positioned circumferentially external to the sprinkler aperture 12. The circumferential step 19 has multiple uses. It allows convenient construction for different sizes of sprinkler apertures 12 with an otherwise single size range of housing caps 11. It also provides a base with a housing for receiving and supporting a step cap 20 to close the sprinkler aperture 12 when a pop-up sprinkler or portions of it may be removed for servicing or winter storage in freeze zones.

Referring to FIGS. 3–6, the fluid conveyance 4 can be attached to the base plate 3 with various means. All provide a sprinkler-attachment portion 6 projected upwardly and a pipe-attachment portion 5 extended downwardly.

FIG. 3 depicts a pipe-attachment portion 5 and a sprinkler-attachment portion 6 constructed integrally with the base plate 3.

FIG. 4 depicts a pipe-attachment portion 5 and a sprinkler-attachment portion 6 fastened to the base plate 3 with straight-thread nuts 21 on straight threads 22 inward linearly from pipe-nipple threads. The fluid conveyance 4 for this embodiment is a pipe nipple having pipe threads on opposite ends and straight threads 22 on a center portion with a slightly larger diameter for the straight-thread nuts 21.

FIG. 5 depicts a pipe-attachment portion 5 and a sprinkler-attachment portion 6 fastened to the base plate 3 with set-screw sleeves 23 having set screws 24 engaging a pipe nipple 25 internally from pipe-nipple threads. The fluid conveyance 4 for this embodiment is a pipe nipple 25 having pipe threads on opposite ends and preferably no threads in a center portion.

FIG. 6 depicts a built-up combination of conventional pipe connectors for construction of the fluid conveyance 4. It has a pipe-attachment portion 5 and a sprinkler-attachment portion 6 fastened to the base plate 3 with a built-up combination of conventional pipe connectors or fittings available in consumer markets. A first reducer pipe nipple 26 has a minor diameter with pipe threads that screw into the underground sprinkler plumbing 10 and a major diameter with threads that screw into internal threads on a first connector sleeve 27. Screwed into internal threads of an opposite end of the first connector sleeve 27 is a second connector sleeve 28 that has internal threads into which threads on a minor diameter of a second reducer pipe nipple 29 are screwed. A major diameter of the second reducer pipe nipple 29 is screwed into internal threads of the sprinkler shaft 8.

Referring further to FIGS. 1 and 5, another built-up combination using conventional components to construct a fluid conveyance 4 is a pipe nipple 25 shown in FIG. 1 having slightly enlarged pipe-sleeve nuts 30 engaging opposite surfaces of the base plate 3.

Other built-up combinations of conventional pipe connectors are foreseeable for constructing the fluid conveyance 4 on opposite sides of the base plate 3 for fluid communication intermediate the underground sprinkler plumbing 10 and the sprinkler shaft 8.

Figure 7:
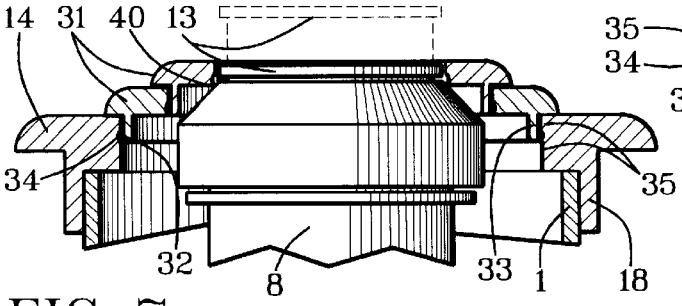
FIG. 7 is a partially cutaway fragmentary portion of a top portion of a sprinkler shaft being retained by a third of a plurality of sprinkler adapters that are attachable with a snap type of quick disconnect.
Figure 8:
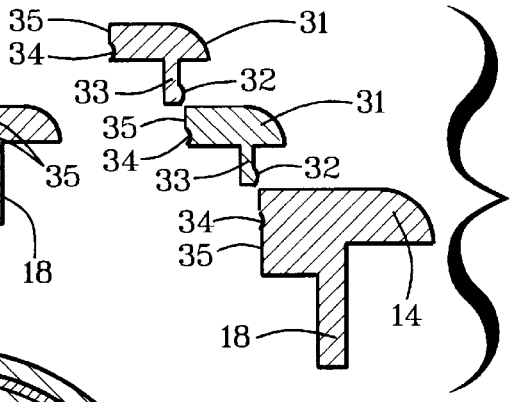
FIG. 8 is an exploded fragmentary portion of the FIG. 7 snap type of quick disconnect in assembly succession.
Figure 9:
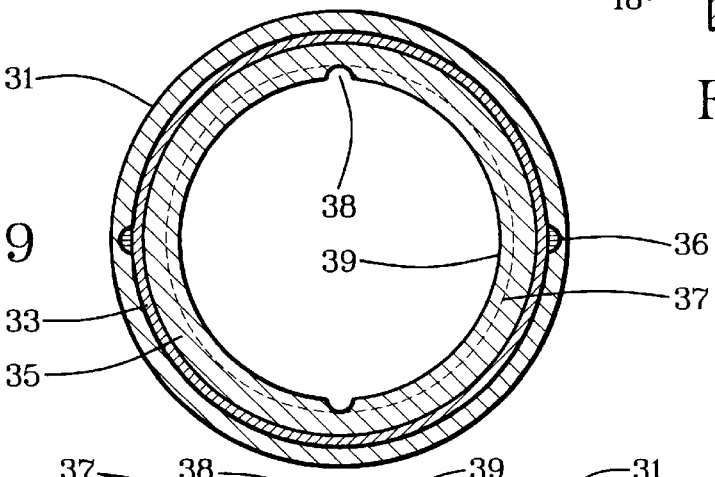
FIG. 9 is a top view of one of a plurality of sprinkler adapters having a leaf-thread type of quick disconnect.
Figure 10:
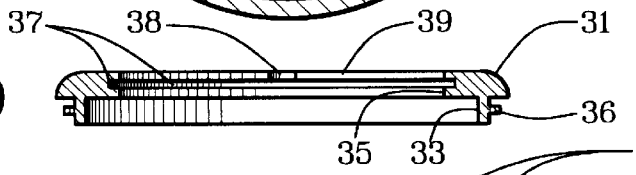
FIG. 10 is a partially cutaway side view of the FIG. 9 illustration.
Figure 11:
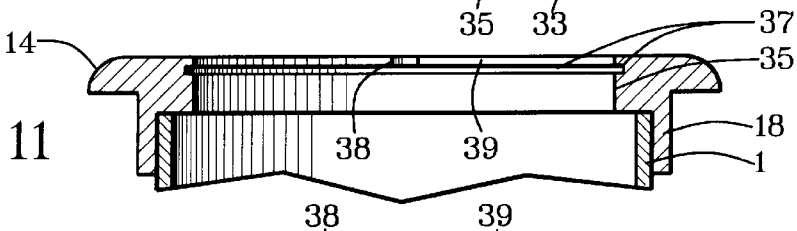
FIG. 11 is a partially cutaway side view of a cap-sleeve shoulder having a leaf-thread type of quick disconnect.
Figure 12:
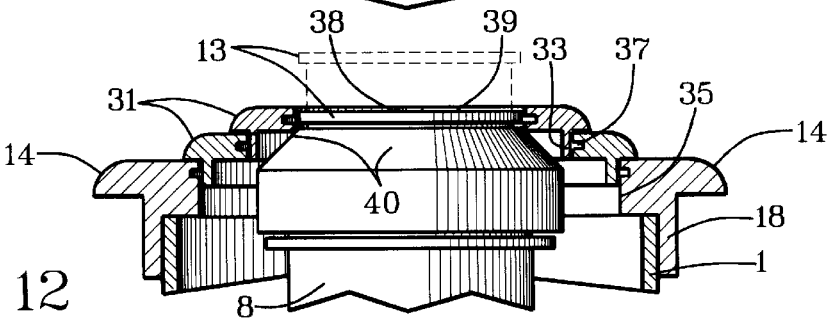
FIG. 12 is a partially cutaway fragmentary portion of a top portion of a sprinkler shaft being retained by a third of a plurality of sprinkler adapters that are attachable with a leaf-thread type of quick disconnect.

Referring to FIGS. 7–8, a plurality of sprinkler adapters 31 can be attached telescopically to the cap-sleeve shoulder 14 directly as depicted or indirectly through the housing cap 11 described in relation to FIG. 1. The sprinkler adapters 31 can be joined together and joined to the cap-sleeve shoulder 14 with a selection of fastener or joining means. Preferably, the joining means is a form of quick-disconnect. The quick-disconnect can be a snap type having snap bosses 32 in first walls 33 and snap receptacles 34 in second walls 35 of telescopic sections of the sprinkler adapters 31. First walls 33 can be adapter sleeves of the sprinkler adapters 31 and second walls 35 can be adapter bases as depicted or vice versa. The snap receptacles 34 are preferably quarter-circle channels positioned as shown and extended full-circle circumferentially to avoid need for lining up snap bosses 32 with snap receptacles 34. The snap bosses 32, however, are preferably quarter-spherical protrusions in order to impart inwardly bending pressure on only a relatively small portion of first walls 33. Different proportions also can be employed.

Referring to FIGS. 9–12, the quick-disconnect can be a leaf-thread type having leaf threads 36 extended outward radially from outside peripheries of first walls 33 of the sprinkler adapters 31, circumferential-channel threads 37 extended outward radially from inside peripheries of second walls 35 of the sprinkler adapters 31 and thread-entry bays 38 in top channel walls 39 of the circumferential-channel threads 37. The circumferential-channel threads 37 can be but need not be inclined or helical for a portion of a circular or arcuate extension in inside peripheries of the second walls 35 of the sprinkler adapters 31.

Inside peripheries of the sprinkler adapters 31 are sized, shaped and positioned to engage outside peripheries of pop-up-housing portions 40 of sprinkler shafts 8 described in relation to FIG. 1 as shown.

To use the snap type of quick-disconnect, sprinkler adapters 31 are merely positioned in telescopic relationship and pushed together linearly for attachment or pulled apart linearly for detachment. To use the leaf-thread type of quick-disconnect, sprinkler adapters 31 are positioned in telescopic relationship with leaf threads 36 in line circumferentially with thread-entry bays 38, pushed together linearly and then turned a portion of a revolution. To detach the leaf-thread type of quick-disconnect, the sprinkler adapters 31 are turned back the same portion of a revolution and pulled apart linearly.

A new and useful pop-up-sprinkler housing having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A pop-up-sprinkler housing comprising:

a cap sleeve having an outside periphery in sliding contact with a periphery of a base sleeve;

the base sleeve having an open top end;

a base plate on a bottom of the base sleeve;

a fluid conveyance having a pipe-attachment portion extended linearly downward from a bottom surface of the base plate and a sprinkler-attachment portion extended linearly upward from a top surface of the base plate;

the pipe-attachment portion of the fluid conveyance having machine threads that can be screwed onto underground sprinkler plumbing;

the sprinkler-attachment portion of the fluid conveyance having machine threads onto which select types and sizes of sprinkler shafts can be screwed;

the fluid conveyance being in fluid communication intermediate the underground sprinkler plumbing and a sprinkler screwed onto the sprinkler-attachment portion of the fluid conveyance;

a housing cap on a top end of the cap sleeve;

the housing cap having a sprinkler aperture that is sized, shaped and positioned centrally in the housing cap to allow ingress and egress of pop-up portions of the select types and sizes of sprinkler shafts; and the housing cap having a cap-sleeve shoulder extended outward radially from the cap sleeve for arresting excessive entry of the cap sleeve into the base sleeve by positioning the cap-sleeve shoulder on a select top surface of an area at a desired height in relationship to a targeted sprinkler-irrigation surface.

2. A pop-up-sprinkler housing as described in claim 1 wherein:

the base plate has at least one drain orifice in fluid communication from the top surface of the base plate to the bottom surface of the base plate.

3. A pop-up-sprinkler housing as described in claim 1 wherein:

the pipe-attachment portion of the fluid conveyance is pipe-threaded externally for screwing into pipe fittings.

4. A pop-up-sprinkler housing as described in claim 1 wherein:

the sprinkler-attachment portion of the fluid conveyance is pipe-threaded externally for screwing into the select types and sizes of sprinkler shafts.

5. A pop-up-sprinkler housing as described in claim 1 wherein:

the fluid conveyance has a pipe nipple with bottom pipe threads on a bottom end that screw into the underground sprinkler plumbing and with top pipe threads on a top end that screw into the select types and sizes of sprinkler shafts;

the bottom pipe threads and the top pipe threads terminate proximate a linearly central portion of the pipe nipple; and the pipe nipple is positioned in the base plate.

6. A pop-up-sprinkler housing as described in claim 1 wherein:

the housing cap has a circumferential step that is sized and shaped to position tops of the select types and sizes of sprinkler shafts in a protected position within the circumferential step.

7. A pop-up-sprinkler housing as described in claim 6 and further comprising:

a step cap that is sized and shaped to fit onto the circumferential step to prevent entry of foreign material into the pop-up sprinkler housing in the absence of a sprinkler shaft attached to the sprinkler-attachment portion of the fluid conveyance.

8. A pop-up-sprinkler housing as described in claim 1 wherein:

the cap-sleeve shoulder has a plurality of sprinkler adapters that are telescopically attachable; and the plurality of sprinkler adapters are sized and shaped with successively smaller inside peripheries to match shaft-holding requirements of pop-up-housing portions of sprinkler shafts having successively smaller outside peripheries of pop-up portions of sprinkler shafts than outside peripheries of pop-up portions that are retained by inside peripheries of the cap-sleeve shoulder.

9. A pop-up-sprinkler housing as described in claim 8 wherein:

the plurality of sprinkler adapters are attachable detachably to cap-sleeve shoulders and to sprinkler adapters having successively smaller inside peripheries than the cap-sleeve shoulders.

10. A pop-up-sprinkler housing as described in claim 9 wherein:

the plurality of sprinkler adapters are attachable detachably with quick-disconnects to cap-sleeve shoulders and to sprinkler adapters having successively smaller inside peripheries than the cap-sleeve shoulders.

11. A pop-up-sprinkler housing as described in claim 10 wherein:

the quick-disconnects are snap quick-disconnects having snap bosses in first walls and snap receptacles in second walls of telescopic sections of the plurality of sprinkler adapters.

12. A pop-up-sprinkler housing as described in claim 10 wherein:

the quick-disconnects are leaf-thread quick-disconnects having leaf threads extended outward radially from first walls of telescopic sections of the plurality sprinkler adapters, circumferential-channel threads extended outward radially from second walls of telescopic sections of the plurality of sprinkler adapters and thread-entry bays in top walls of the circumferential-channel threads.

* * * * *